US007086471B2

(12) United States Patent
Cantin et al.

(10) Patent No.: US 7,086,471 B2
(45) Date of Patent: Aug. 8, 2006

(54) METHOD AND APPARATUS FOR CONTROLLING DOWNHOLE FLOW

(75) Inventors: Gilles Cantin, Verriéres le Buisson (FR); Vincent Gergele, Paris (FR); Vincent Tourillon, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 163 days.

(21) Appl. No.: 10/474,608

(22) PCT Filed: Apr. 9, 2002

(86) PCT No.: PCT/EP02/04010

§ 371 (c)(1),
(2), (4) Date: Mar. 29, 2004

(87) PCT Pub. No.: WO02/084071

PCT Pub. Date: Oct. 24, 2002

(65) Prior Publication Data

US 2004/0149447 A1 Aug. 5, 2004

(30) Foreign Application Priority Data

Apr. 12, 2001 (FR) ..... 01 05066

(51) Int. Cl.
*E21B 34/10* (2006.01)

(52) U.S. Cl. ..... 166/313; 166/353; 166/321

(58) Field of Classification Search ..... 166/313, 166/353

See application file for complete search history.

(56) References Cited

U.S. PATENT DOCUMENTS

| | | | | |
|---|---|---|---|---|
| 3,765,483 | A * | 10/1973 | Vencil | 166/265 |
| 3,948,318 | A * | 4/1976 | Page, Jr. | 166/323 |
| 4,453,599 | A * | 6/1984 | Fredd | 166/374 |
| 4,729,433 | A * | 3/1988 | Jacob | 166/322 |
| 5,957,208 | A * | 9/1999 | Schnatzmeyer | 166/373 |
| 6,422,317 | B1 * | 7/2002 | Williamson, Jr. | 166/374 |
| 2004/0108116 | A1 * | 6/2004 | McLoughlin et al. | 166/321 |

* cited by examiner

*Primary Examiner*—Frank S. Tsay
(74) *Attorney, Agent, or Firm*—Victor H. Segura; Brigitte L. Echols

(57) ABSTRACT

The invention relates to apparatus for controlling the flow rate of a fluid in tubing (4), said apparatus (5) comprising at least one hole (7) passing through the wall of said tubing and a moving shutterjacket (8) mounted to engage said hole. According to the invention, said apparatus further comprises deflector means (9) covering said jacket and said hole so that said deflector means directs the fluid through the wall of said tubing.

20 Claims, 3 Drawing Sheets

METHOD AND APPARATUS FOR CONTROLLING DOWNHOLE FLOW

The invention relates to a method and apparatus designed for controlling the flow rate and for directing the flow of a petroleum fluid flowing at the bottom of a well via tubing. A preferred application of the invention relates to wells possessing two different hydrocarbon reservoirs or to deviated or horizontal wells that branch multilaterally.

It is known to place adjustable flow rate valves down a well in production in order to optimize production, in particular in the event of a petroleum fluid produced from at least two spaced apart locations. Adjustable flow rate valves are fitted on tubing, so as to define an adjustable flow section between the inside of the tubing and the annular space surrounding it. As a general rule they comprise a sliding shutter jacket placed inside the tubing and holes formed through the tubing level with the jacket. They further comprise actuators that are remotely controlled from the surface to move the shutter jacket parallel to the axis of the tubing. These valves can also be used in injection wells, to control the flow rate of fluid sent into the underground formation.

Documents WO-A-97/37102 and FR-A-2 790 510 relate to such variable flow rate valves. The latter document describes a flow rate control device whose shutter jacket is mounted on the tubing so as to move parallel to its axis. The jacket is suitable for moving between a low or front position corresponding to closure of the flow rate control device and a high or rear position corresponding to the device being fully open. Between those two extreme positions, the shutter jacket can be moved continuously so as to vary the flow section at will and consequently vary the flow rate of the petroleum fluid flowing through the device. An actuator acts on an intermediate piece connected to the shutter jacket to move it. The petroleum fluid coming from the deposit penetrates into the tubing via the flow section from the annulus between said tubing and the walls of the well which are reinforced with casing.

This type of control device is not suitable when the fluid penetrates directly into the tube on which the shutter jacket is mounted. Such circumstances can arise when producing from two different zones, for example. Under such circumstances, it is often necessary to separate the production from the two zones so as to avoid degrading the production from one zone, e.g. when the other zone has reached a water pocket. In such configurations, the fluid from the deeper deposit penetrates directly into the tubing while the fluid from the higher deposit flows between the casing and the tubing. Another example is when the main well splits into two substantially horizontal and parallel wells, e.g. for the purpose of working a petroleum deposit to the maximum while avoiding layers of water that surround it. Under such circumstances, the main well likewise receives two production streams which it can advantageous to keep separate.

Normally, the flow control apparatus is located close to the producing zone. However, there are certain circumstances where this is not possible because space restrictions mean that positioning such apparatus in the well would interfere with the flow in the well excessively or because there is insufficient space to install the apparatus at all.

It is an object of the invention to provide methods, apparatus and systems which avoid some or all of these problems.

The invention provides apparatus for controlling the flow rate of a fluid in tubing, said apparatus comprising at least one hole passing through the wall of said tubing and a moving shutter jacket mounted to engage said hole, the apparatus being characterized in that said apparatus further comprises deflector means covering said jacket and said hole so that said deflector means directs the fluid through the wall of said tubing.

With the apparatus of the invention, for effluent flowing inside tubing or when the tubing directly receives the effluent leaving perforations formed through the casing lining the walls of the well, it is possible to control the production flow rate in a manner that is very simple and effective. The deflector means thus makes it possible to use flow rate control apparatus in a wide variety of different applications, both in production wells and in injection wells, without any need to modify the equipment for each application.

It is preferred that the tubing is connected to a producing region of the well and the apparatus is located above the producing region. The tubing can pass through another producing region of the well, the fluids produced from which can themselves be directed to another flow control apparatus of the invention by a second tubing.

By directing the flow from the producing region through the tubing, it is possible to locate the flow control apparatus in a region of the well where there are fewer restrictions on space available for such hardware installations.

In a preferred embodiment of the invention, the deflector means is a substantially cylindrical shell mounted outside the tubing. In this embodiment, the apparatus of the invention further comprises stop means plugging the inside of the tubing on which the deflector means is mounted.

The apparatus of the invention is equally suitable for controlling fluid flow rate in a production well or in an injection well, i.e. when the fluid flows from inside the tubing so as to go into a petroleum deposit through which the well passes, with the fluid passing directly via the annulus between the wall of the well and the wall of the tubing, or else via another segment of tubing prior to reaching the deposit.

In an advantageous embodiment of the invention, the stop means is a plug removably mounted inside the tube.

By co-operating with the deflector means, the stop means makes it possible to deflect the fluid effectively towards the hole through the wall of the tubing. Nevertheless, it is particularly advantageous to be able to release the inside of the tubing by removing said stop means. This makes it possible not only to lower other tools to perform other measurements inside the well, but also to gain access to zones that are further down for any type of operation: repairing the casing covering the walls of the well, or acting on the petroleum deposit.

In a preferred embodiment of the invention, the apparatus further comprises control means suitable for moving the shutter jacket These control means also act on the shutter jacket via a control rod. In which case, the shutter jacket and the control rod are mounted on the outside of the tubing. Advantageously, a first portion of the control rod is covered by the deflector means while a second portion of said rod, situated outside said deflector means, is connected to the control means.

In this manner, the forces generated by the "bottom effect", i.e. the pressure difference between the inside of the deflector means and the outside medium, applies only on a relatively small area, corresponding to the diameter of the rod. Thus, by appropriate dimensioning of the diameter of the rod it is possible to ensure that the control means operate effectively and reliably to move the shutter jacket.

Advantageously, the apparatus of the invention further comprises a protection jacket mounted in line with the shutter jacket and urged towards it by resilient means so as to bring the protection jacket automatically into a position in which it overlies sealing means mounted on the tubing on the side of the hole remote from the shutter jacket when said shutter jacket is not covering said sealing means.

In an embodiment, the tubing comprises at least two segments, a first segment having the hole passing through its wall and including the shutter jacket, and a second segment connected to said first segment via the deflector means.

In a particularly advantageous embodiment of the invention, the tubing is a segment of a production tube placed inside a well passing through a first petroleum reservoir, and the fluid whose flow rate is to be controlled is effluent from said first reservoir, said effluent flowing inside said tubing.

Other advantages and characteristics of the invention appear from the following description given by way of example and made with reference to the accompanying drawings, in which:

FIG. 1*a* is a diagram showing the principle on which a portion of the control apparatus of the invention operates;

FIG. 1*b* is a section view through an embodiment of flow rate control apparatus in accordance with the invention;

Figure 1A:
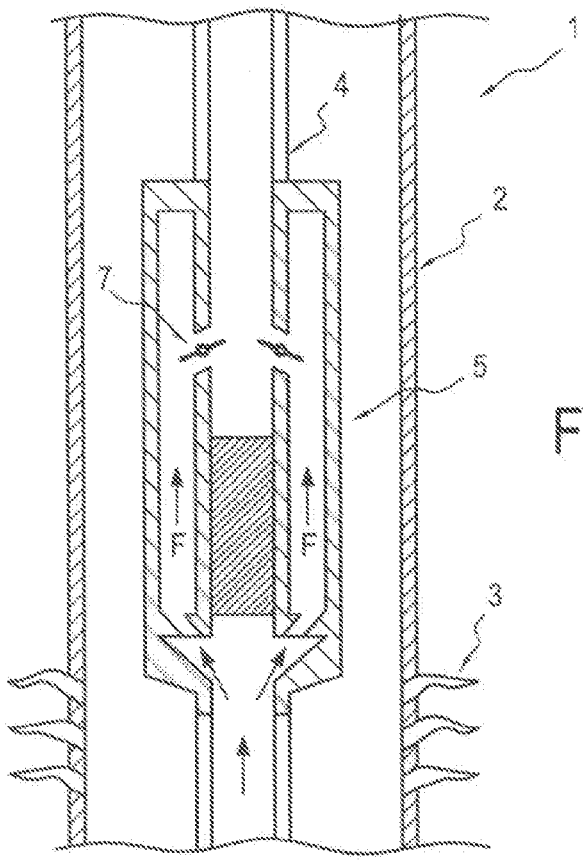

In FIG. 1*a*, reference 1 designates an oil well in production, with only a downhole region thereof being shown. It should be observed that this downhole region could extend vertically, as shown, or horizontally, or obliquely, without going beyond the ambit of the invention. Similarly, without going beyond the invention, the well could be an injection well. The walls of the well 1 are reinforced by casing 2. In the region of the well shown in FIG. 1*a*, the casing 2 is perforated at 3 so as to put the well into communication with a natural deposit of petroleum fluid (not shown).

In order to enable the petroleum fluid to be taken to the surface, tubing 4 is received coaxially in the well 1 along its entire length. The tubing is made up of a certain number of tube segments connected end to end. As shown in FIG. 1*a*, one of these segments forms the body of the flow rate control apparatus 5. For simplification purposes, the word "tubing" is used below to refer both to the tube as a hole and to its segment forming the body of the apparatus 5. The segment forming the body of the control apparatus can be situated at any level amongst the other segments of the tubing 4. Essentially, the flow rate control apparatus of the invention comprises at least one hole 7 formed through the wall of the tubing 4, a shutter jacket 8, and a deflector 9 for directing the fluid through the hole 7. In practice, the control apparatus can have a plurality of holes 7 regularly distributed all around the circumference of the tubing and, for example, being elongate in the axial direction of the tubing. The number and shape of holes can be freely selected without going beyond the ambit of the invention.

Figure 1B:
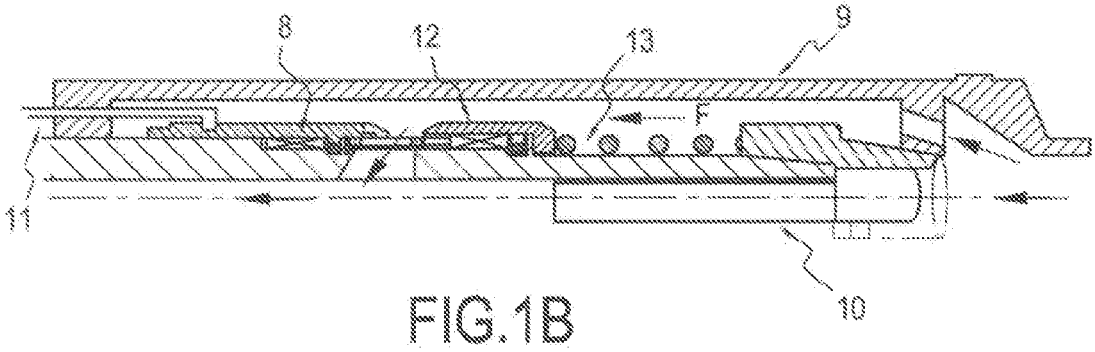

The deflector 9 is mounted on the outside of one end of the tubing and it covers the shutter jacket 8. A plug 10 is removably mounted at the same end as the end having the deflector, the plug serving to prevent the fluid from penetrating into the tubing via said end. In association with the deflector 9, the plug serves to deflect the fluid towards the hole 7 through the tubing. As shown in FIG. 1*b*, the segment which constitutes the body of the flow rate control apparatus of the invention is the last segment of the tubing. In which case, this segment lies immediately above the perforations 3 through the casing covering the walls of the well. Sealing devices (not shown) situated on either side of the tubing prevents the fluid from rising in the annulus between the walls of the casing 2 and the walls of said tubing. Under such circumstances, the entire fluid flow represented by arrows F in FIG. 1*a* is sent directly towards the inside of the tubing to which access is prevented by the plug 10. The deflector 9 channels this fluid towards the shutter jacket 8 and the hole 7 so as to enable the flow rate of the fluid to be controlled. When the segment including the control apparatus is not the last segment of tubing, then the deflector provides the link between said last segment and the segment comprising the control apparatus. In this way, the fluid flowing in the last segment and reaching the plug 10 does not penetrate directly into the flow rate control segment but is deflected by the deflector so as to flow initially between said deflector and the outside wall of said segment prior to returning into the segment via the hole 7 at a flow rate that is determined by the position of the shutter jacket 8.

The deflector 9 can be of any shape providing it channels the fluid towards the hole 7. Similarly, the plug 10 can be of any shape providing it closes off one end of the tubing from the outside where the fluid arrives. Thus, the plug could be installed on a permanent basis.

Nevertheless, it is advantageous for the plug to be removable. This makes it possible firstly to install the apparatus easily, with the plug being mounted on the tubing immediately before the tubing is lowered down the well. Thereafter, access to zones lower down the well are not shut off in this way once the apparatus has been lowered. In other words, by removing the plug 10, it is still possible to lower other measurement tools inside the tubing on the end of a cable to measure other operating parameters of the well: temperature, pressure, etc. . . . . It is also possible to use the inside of the tubing to perform operations of repairing the casing 2 or to take action on the petroleum deposit, e.g. to perform operations such as fracturing, known in the state of the art.

In a known embodiment, the plug 10 is held by means of anchor fingers (not shown for greater clarity). These anchor fingers are initially retracted into the plug so as to enable the plug to be lowered down the tubing and positioned at a level which is determined by the presence of a positioning abutment (also not shown). Then, after passing abutment, the anchor fingers are extended from the plug to co-operate firmly with receiver grooves formed in the inside walls of the tubing. When it is necessary to remove the plug 10, the plug is raised to the surface after its anchor fingers have been retracted by conventional means (not shown). At the surface, by reengaging the mechanism for causing the anchor fingers to be extended, it is possible to lower the plug down again after measurement operations or repair operations have been completed, and to fix the plug back into position inside the tubing.

Thereafter, it is advantageous for the overall diameter of the segment of tubing fitted with the deflector on its outside walls not to exceed the maximum diameter of a standard segment of tubing. This characteristic makes it possible to use the control apparatus of the invention in any existing well without requiring special arrangements that are always expensive. Unfortunately, that means the inside diameter of the segment of tubing fitted with the deflector is significantly smaller than the diameter of the tubing that is not so equipped, which is detrimental to the maximum flow rate that can be accepted in said segment. Nevertheless, this segment can be built to any diameter with precedence being given either to making the apparatus more adaptable, or to increasing the production or injection flow rate.

The shutter jacket 8 is movable over the hole 7 in such a manner as to cover said hole to a greater or lesser extent, thereby controlling the fluid flow rate into the inside of the tubing. The jacket is therefore connected to control means, represented solely by a single actuator rod 11 in the drawings. As can be seen in FIG. 1*b*, only a first portion of the actuator rod connected to the jacket 8 is situated inside the deflector 9, and a second portion connected to control means extends outside the deflector. This configuration provides a significant advantage over prior art actuator devices. The forces generated by the "bottom effect", i.e. by the pressure difference between the inside of the deflector and the medium surrounding it, i.e. the annulus between the tubing and the casing, acts only on a small area corresponding to the diameter of the actuator rod 11. Thus, by appropriately dimensioning this diameter, it is possible to minimize the force that needs to be exerted to move the moving jacket, and thus the force that needs to be deployed by the actuator means. The smaller the diameter of the actuator rod, the smaller the force to which said rod is subjected due to the pressure difference. Sealing rings (not shown) are placed at the junction between the portion of the rod inside the deflector and its other portion outside it.

In the embodiment of FIG. 1*b* where the shutter jacket is outside the tubing (said jacket could be inside the tubing without going beyond the ambit of the invention), sealing means are placed in annular grooves formed in the outside surface of the tubing so as to co-operate in sealing manner with the inside surface of the shutter jacket 8. By way of example, these sealing means are constituted by dynamic sealing gaskets of annular shape, and made of a flexible material such as an elastomer.

In the embodiment shown in FIG. 1*b*, the flow rate control apparatus 5 also comprises, beneath the shutter jacket 8 and in line therewith, a protection jacket 12. This protection jacket essentially has the function of providing continuous covering for the sealing means when the shutter jacket 8 moves upwards, i.e. when the control rod 11 is actuated in the direction to open the flow rate control apparatus 5. Return means 13 are also provided and arranged so as to ensure that the protection jacket 12 is returned automatically into a position where it covers the sealing means when the sealing means are no longer co-operating with the shutter jacket 8. In the example shown, these return means are implemented as a compression spring. The return means 13 hold the protection jacket 12 pressed against the end of the shutter jacket 8 until the control apparatus 5 begins to open. Thereafter, the protection jacket bears against an abutment (not shown) of the tubing, so as to overlie the sealing means.

Figure 2:
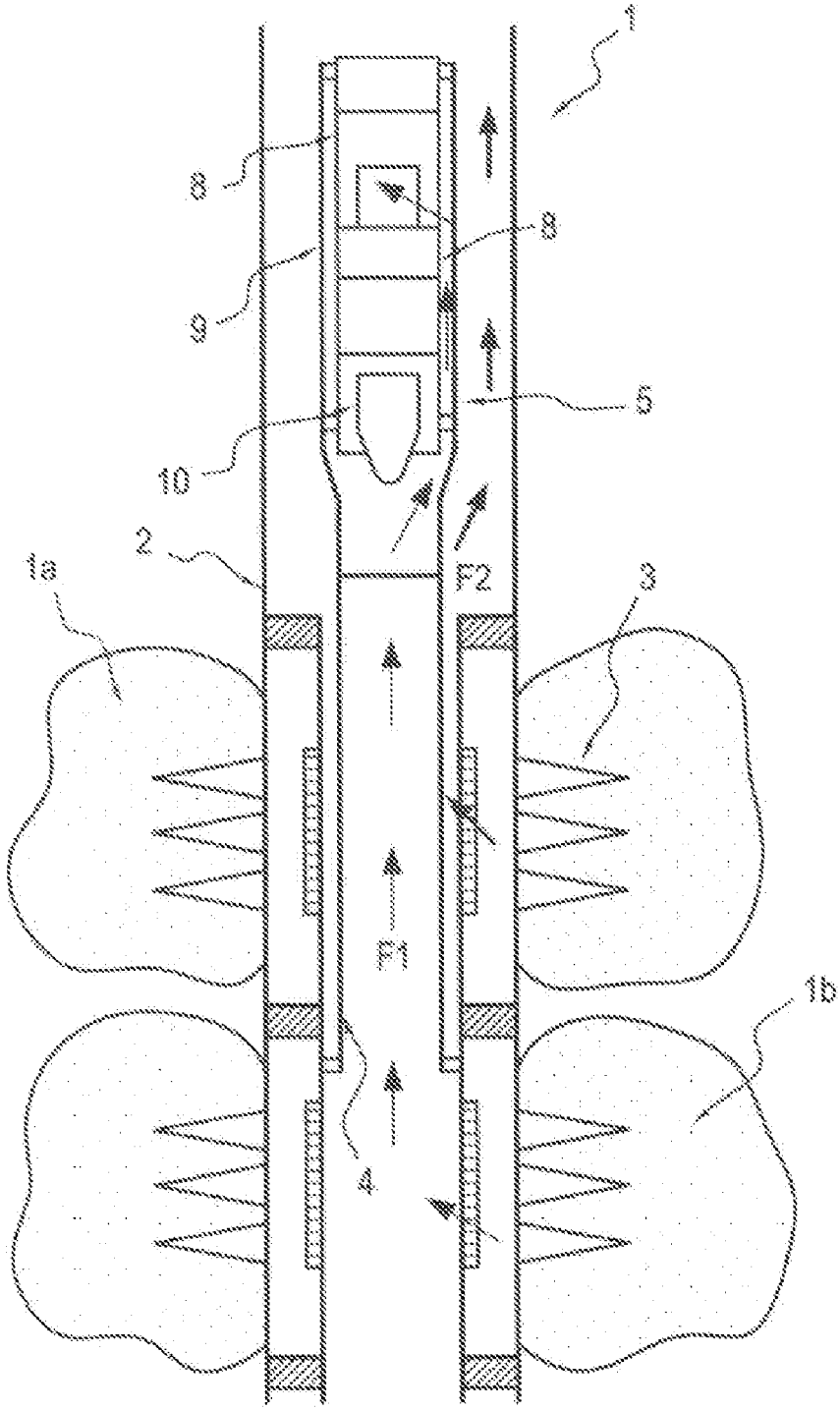
FIG. 2 shows a first application of such apparatus.

FIG. 2 shows a first application of the control apparatus 5 of the invention. In this application, a well 1 lined with casing 2 passes through an underground formation having at least two reservoirs 1*a* and 1*b* situated at different locations. Perforations 3 are formed through the casing 2 so as to reach both the upper reservoir 1*a* and the lower reservoir 1*b*. The well 1 thus has two different production zones. It is of great importance to keep separate the flows coming from these two production zones. It is necessary to avoid contaminating the production from one of the reservoirs with the flow coming from the other, for example in the event of a sheet of water being encountered in said other reservoir. Furthermore, it is advantageous to be able to control the flow rates from each of these reservoirs separately.

Under such circumstances, the control apparatus of the invention is particularly suitable. To separate the flow F2 extracted from the upper reservoir 1*a* from the flow F1 extracted from the lower reservoir 1*b*, the upper flow passes via the annulus between the tubing and the casing 2 and can therefore be controlled by a conventional flow rate control device (not shown). The flow coming from the lower reservoir penetrates directly into the inside of the tubing 4. Under such circumstances, this flow directly encounters the plug 10 where it is directed by the deflector 9 towards the hole 7 and the shutter jacket 8. It is thus possible to control the rate of this flow by adjusting the overlap position of the shutter jacket and the hole through the tubing. This makes it very simple to control the flow rate from two reservoirs situated at two different levels or locations through which the same well 1 passes.

Where the two reservoirs or producing regions 1*a*, 1*b* are completed using a sand screen or like device, there may not be sufficient space to locate the flow control apparatus in the producing region. The present invention allows the flow from such a region to be directed separately to another part of the well in which the flow control apparatus can be located without detrimental effect to the flow from any of the producing regions.

Figure 3:
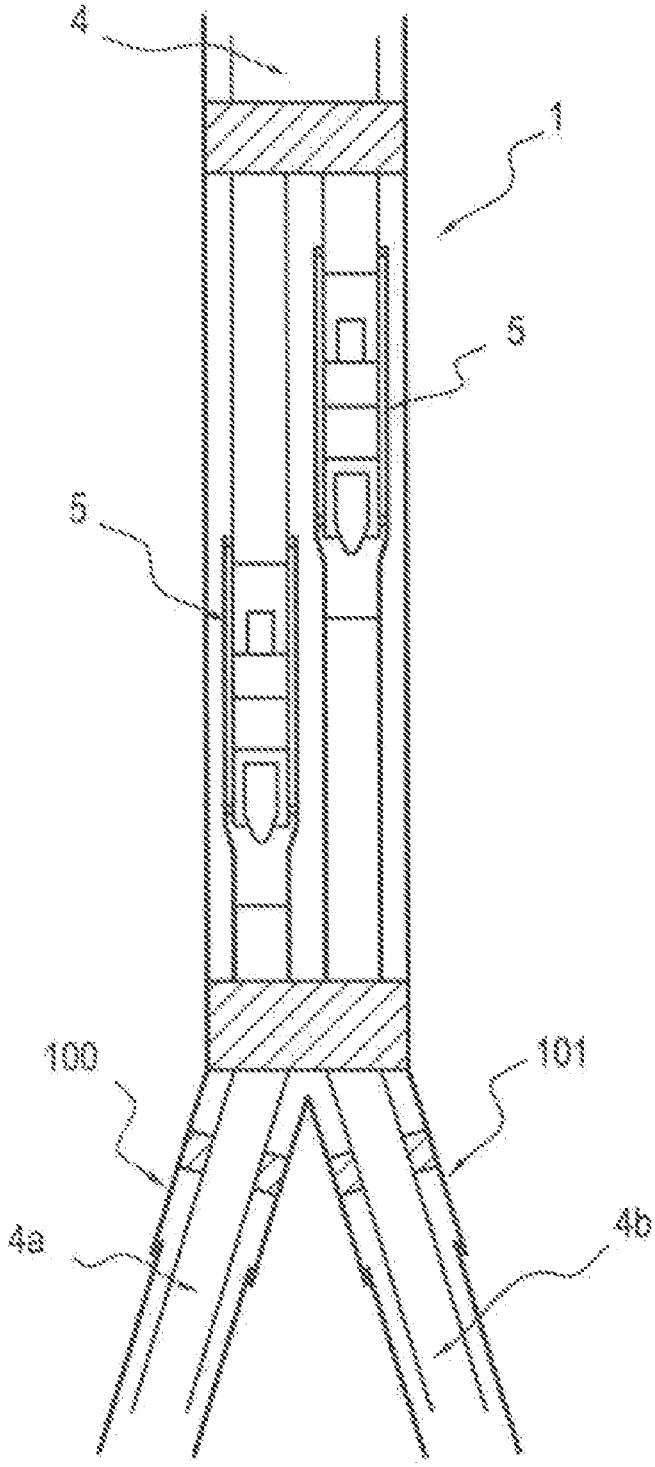
FIG. 3 shows a second application of said apparatus.

FIG. 3 shows another application in which it is advantageous to use flow rate control apparatus in accordance with et invention. In this case, a well 1 passing through an underground formation branches into two ducts 100 and 101 going to two reservoirs (not shown) whose flows are delivered via two distinct production tubes 4*a* and 4*b* that are united to form a single tube 4 leading to the surface. The flows penetrate directly into the production tubes 4*a* and 4*b* and it is necessary to deflect them with flow rate control apparatuses 5 of the invention. In practice, this application generally corresponds to a multilateral well.

The control apparatus of the invention thus makes it simple and reliable to regulate the flow rate of a fluid flowing in tubing, through a hole that is covered by a movable shutter jacket.

The invention claimed is:

1. Apparatus for controlling the flow rate of a fluid in a well, the apparatus including a tubing (4) passing from a first producing region of the well to a location above the first producing region, the apparatus (5) comprising, in the location above the producing region, at least one hole (7) passing through the wall of the tubing and a moving shutter jacket (8) mounted to engage the hole, the apparatus being characterized in that the apparatus further comprises:

deflector means (9) covering the jacket and the hole so that the deflector means directs the fluid through the wall of the tubing;

a protection jacket (12) mounted in line with the shutter jacket and urged towards it by resilient means (13) so as to bring the protection jacket automatically into a position in which it overlies sealing means mounted on the tubing (4) on the side of the hole (7) remote from the shutter jacket (8) when said shutter jacket is not covering said sealing means.

2. Apparatus as claimed in claim 1, characterized in that the deflector means (9) is a substantially cylindrical shell mounted outside the tubing (4).

3. Apparatus as claimed in claim 2, characterized in that it further comprises stop means (10) plugging the inside of the tubing on which the deflector means is mounted.

4. Apparatus as claimed in claim 3, characterized in that the stop means is a plug removably mounted inside the tube.

5. Apparatus as claimed in claim 1, characterized in that it further comprises control means suitable for moving the shutter jacket (8).

6. Apparatus as claimed in claim 4, characterized in that it further comprises control means suitable for moving the shutter jacket (8).

7. Apparatus as claimed in claim 6, characterized in that the control means act on the shutter jacket (8) via a control rod (11).

8. Apparatus as claimed in claim 7, characterized in that the shutter jacket and the control rod are mounted outside the tubing.

9. Apparatus as claimed in claim 8, characterized in that a first portion of the control rod (11) is covered by the deflector means (9) while a second portion of the rod, situated outside the deflector means, is connected to the control means.

10. Apparatus as claimed in claim 1, characterized in that the tubing (4) comprises at least two segments, a first segment having the hole passing through its wall and including the shutter jacket, and a second segment connected to the first segment via the deflector means (9).

11. The use of an apparatus for controlling the flow rate of a fluid in a well, the apparatus including a tubing (4) passing from a first producing region of the well to a location above the first producing region, the apparatus (5) comprising, in the location above the producing region, at least one hole (7) passing through the wall of the tubing, a moving shutter jacket (8) mounted to engage the hole and deflector means (9) covering the jacket and the hole so that the deflector means directs the fluid through the wall of the tubing, said use being characterized by the fact that:

the tubing (4) is a segment of a production tube placed inside a well (1) passing through a first petroleum reservoir (1*b*);

the fluid whose flow rate is to be controlled is effluent from the first reservoir, the effluent flowing inside the tubing; and the well (1) passes through a second reservoir (1*a*) situated above the first reservoir (1*b*), with the effluent from the second reservoir flowing in the annulus between the tubing (4) and the walls of the well.

12. A system for controlling flow in a well including first and second producing regions, the system comprising first and second tubings receiving fluids produced from the first and second regions respectively, the first tubing extending from the first region into a first flow control apparatus located above the first and second regions and comprising at least one hole (7) passing through the wall of the first tubing and a moving shutter jacket (8) mounted to engage the hole, deflector means (9) covering the jacket and the hole such that the deflector means directs the fluid through the wall of the first tubing.

13. A system as claimed in claim 12, the second tubing extends from the second region into a second flow control apparatus located above the first and second regions and comprising at least one hole (7) passing through the wall of the second tubing and a moving shutter jacket (8) mounted to engage the hole, deflector means (9) covering the jacket and the hole such that the deflector means directs the fluid through the wall of the tubing.

14. A system as claimed in claim 12, wherein the second region is located above the first region and the first tubing passes through the second region to the first flow control apparatus.

15. A system as claimed in claim 13, wherein the second region is located above the first region and the first tubing passes through the second region to the first flow control apparatus.

16. A system as claimed in claim 12, wherein the first and second regions are located in separate branches of a multilateral well, and the first and second flow control apparatus are located in a part of the well into which the branches are connected.

17. A system as claimed in claim 13, wherein the first and second regions are located in separate branches of a multilateral well, and the first and second flow control apparatus are located in a part of the well into which the branches are connected.

18. A system as claimed in claimed 12, wherein at least one of the first or second regions is completed with a sand screen.

19. A system as claimed in claim 15, wherein at least one of the first or second regions is completed with a sand screen.

20. A system as claimed in claim 17, wherein at least one of the first or second regions is completed with a sand screen.

* * * * *